US010466646B2

(12) United States Patent
Ichikawa et al.

(10) Patent No.: US 10,466,646 B2
(45) Date of Patent: Nov. 5, 2019

(54) PROCESS CARTRIDGE AND IMAGE FORMING APPARATUS

(71) Applicant: BROTHER KOGYO KABUSHIKI KAISHA, Nagoya-shi, Aichi-ken (JP)

(72) Inventors: Tomoya Ichikawa, Nagoya (JP); Takashi Shimizu, Nagoya (JP); Masaaki Furukawa, Nagoya (JP); Naoya Kamimura, Ichinomiya (JP); Takashi Yasuda, Nagoya (JP); Masanari Yoshikawa, Nagoya (JP); Koji Abe, Okazaki (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 15/928,561

(22) Filed: Mar. 22, 2018

(65) Prior Publication Data

US 2019/0033779 A1 Jan. 31, 2019

(30) Foreign Application Priority Data

Jul. 31, 2017 (JP) ..... 2017-148047

(51) Int. Cl.
*G03G 15/16* (2006.01)
*G03G 21/18* (2006.01)
*G03G 15/02* (2006.01)

(52) U.S. Cl.
CPC ..... *G03G 21/1814* (2013.01); *G03G 15/0291* (2013.01); *G03G 15/1605* (2013.01); *G03G 21/1821* (2013.01); *G03G 21/1857* (2013.01)

(58) Field of Classification Search
CPC ..... G03G 21/1814; G03G 21/1821; G03G 21/1857; G03G 15/0291; G03G 15/1605
See application file for complete search history.

(56) References Cited

U.S. PATENT DOCUMENTS

2014/0099145 A1* 4/2014 Nakajima ..... G03G 21/1821 399/113
2015/0277352 A1* 10/2015 Abe ..... G03G 21/1821 399/116

FOREIGN PATENT DOCUMENTS

JP 2010-271352 A 12/2010

* cited by examiner

*Primary Examiner* — David M. Gray
*Assistant Examiner* — Michael A Harrison
(74) *Attorney, Agent, or Firm* — Merchant & Gould P.C.

(57) ABSTRACT

A photosensitive drum is rotatable about a first axis extending in a particular direction. A frame rotatably supports the photosensitive drum. A developing roller is rotatable according to driving force about a second axis extending in the particular direction. A surface of the developing roller contacts a surface of the photosensitive drum through toner. A resistance generating member generates a resistance torque TQ1 serving as resistance between the frame and photosensitive drum in a case where the photosensitive drum rotates relative to the frame. In a case where the developing roller rotates according to the driving force in a state where the surface of the developing roller contacts the surface of the photosensitive drum through toner, the resistance torque TQ1 is smaller than a torque TQ2 that causes the photosensitive drum to rotate due to friction between the surface of the developing roller and the surface of the photosensitive drum.

24 Claims, 7 Drawing Sheets

PROCESS CARTRIDGE AND IMAGE FORMING APPARATUS

CROSS REFERENCE TO RELATED APPLICATIONS

This application claims priority from Japanese Patent Application No. 2017-148047 filed Jul. 31, 2017. The entire content of the priority application is incorporated herein by reference.

TECHNICAL FIELD

This disclosure relates to a process cartridge detachably attached to an apparatus main body of an image forming apparatus and to an image forming apparatus having the process cartridge.

BACKGROUND

A process cartridge having a photosensitive drum and a developing roller is known. A process cartridge generally includes a photosensitive drum and a developing roller. The photosensitive drum rotates by receiving driving force from a gear provided at the apparatus main body, and the developing roller rotates by receiving driving force from a coupling.

SUMMARY

According to one aspect, this specification discloses a process cartridge. The process cartridge includes a photosensitive drum, a frame, a developing roller, and a resistance generating member. The photosensitive drum is rotatable about a first axis extending in a particular direction. The frame rotatably supports the photosensitive drum. The developing roller is rotatable according to driving force about a second axis extending in the particular direction. A surface of the developing roller contacts a surface of the photosensitive drum through toner. The resistance generating member is configured to generate a resistance torque TQ1 serving as resistance between the frame and photosensitive drum in a case where the photosensitive drum rotates relative to the frame. In a case where the developing roller rotates according to the driving force in a state where the surface of the developing roller contacts the surface of the photosensitive drum through toner, the resistance torque TQ1 is smaller than a torque TQ2 that causes the photosensitive drum to rotate due to friction between the surface of the developing roller and the surface of the photosensitive drum.

According to another aspect, this specification also discloses an image forming apparatus. The image forming apparatus includes a process cartridge and an apparatus main body to which the process cartridge is mounted. The process cartridge includes a photosensitive drum, a frame, a developing roller, a resistance generating member, and a coupling. The photosensitive drum is rotatable about a first axis extending in a particular direction. The photosensitive drum includes a first gear. The frame rotatably supports the photosensitive drum. The developing roller is rotatable according to driving force about a second axis extending in the particular direction. A surface of the developing roller contacts a surface of the photosensitive drum through toner. The resistance generating member is configured to generate a resistance torque serving as resistance between the frame and photosensitive drum in a case where the photosensitive drum rotates relative to the frame. The coupling is configured to receive the driving force. In a case where the developing roller rotates according to the driving force in a state where the surface of the developing roller contacts the surface of the photosensitive drum through toner, the resistance torque TQ1 is smaller than a torque TQ2 that causes the photosensitive drum to rotate due to friction between the surface of the developing roller and the surface of the photosensitive drum. The apparatus main body includes a motor, a second gear, and a driving-force input member. The second gear engages the first gear. The second gear is rotatable at a rotational speed in accordance with a rotational speed of the motor. The driving-force input member is configured to input the driving force to the developing roller.

BRIEF DESCRIPTION OF THE DRAWINGS

Embodiments in accordance with this disclosure will be described in detail with reference to the following figures wherein.

DETAILED DESCRIPTION

Generally, the photosensitive drum rotates with uneven rotational speed caused by, as disturbances, entrance of a sheet of paper or contact of the developing roller with the photosensitive drum. If there is any rotational unevenness of the photosensitive drum, there may be a problem that a belt-like pattern called "banding" appears in the formed images.

Therefore, in order to suppress such rotation unevenness of the photosensitive drum due to the disturbances, in a comparative example, a component that generates friction resistance is provided between a frame of the process cartridge and the photosensitive drum. The friction resistance is set to a value that is larger than a rotation torque exerted on the photosensitive drum due to the friction between the surface of the photosensitive drum and the surface of the developing roller.

In the comparative example, however, large rotational resistance on the photosensitive drum is caused by the component that generates friction resistance between the frame and the photosensitive drum. Thus, it is necessary to input large driving force to the photosensitive drum. Moreover, another driving force other than the one inputted to the photosensitive drum is inputted to the developing roller.

Thus, large driving force is necessary to drive the photosensitive drum and the developing roller.

An example of the object of this disclosure is to provide a process cartridge and an image forming apparatus that rotates a photosensitive drum and a developing roller with small driving force.

An embodiment of this disclosure will be described in detail with reference to the attached drawings. First, a schematic configuration of a laser printer 1 as an example of an image forming apparatus will be described with reference to FIG. 1.

Figure 1:
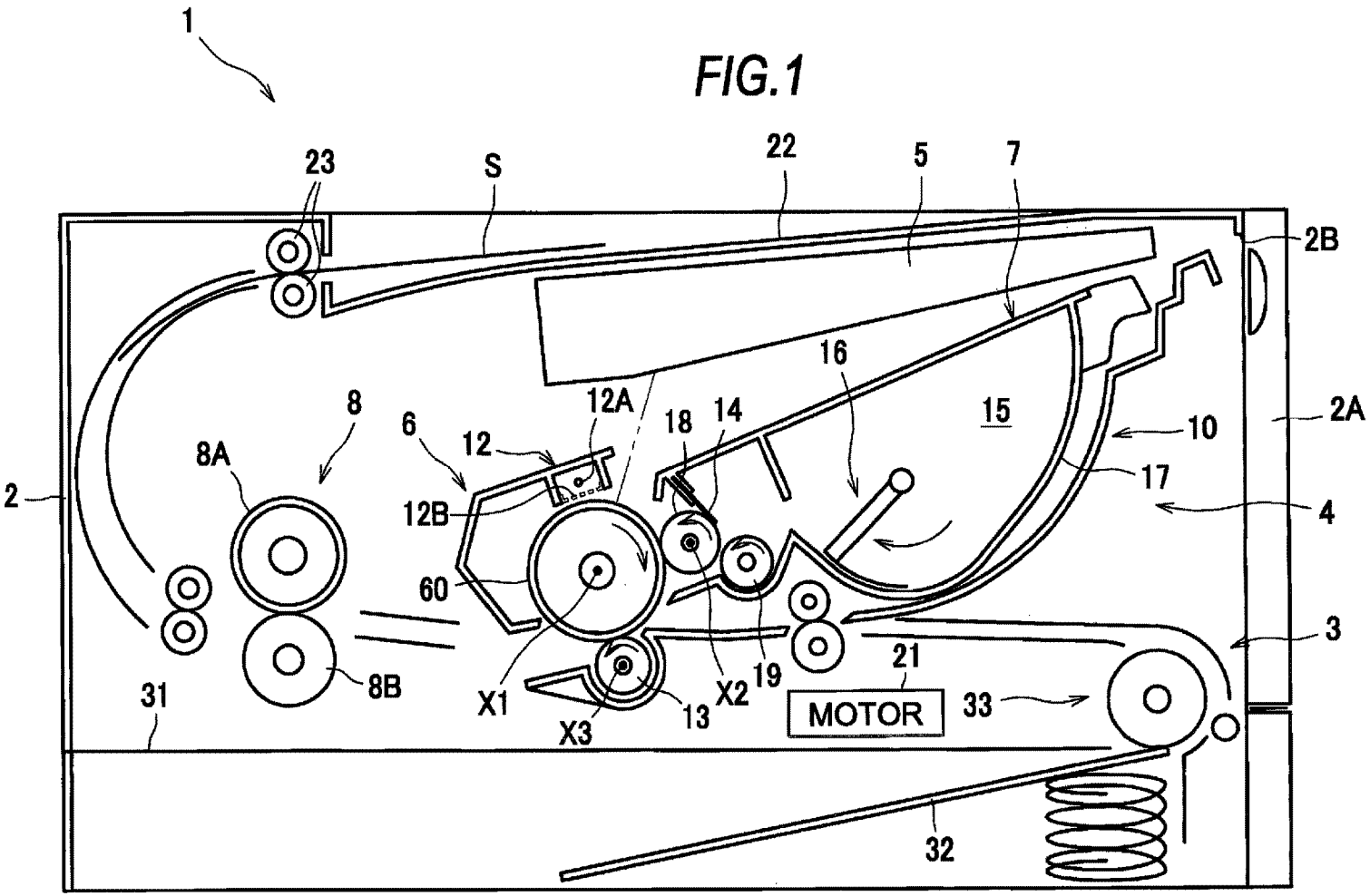
FIG. 1 is a cross-sectional view of a schematic configuration of a laser printer according to an embodiment.

As shown in FIG. 1, the laser printer 1 includes a main casing 2 as an example of an apparatus main body, a feeder section 3, and an image forming section 4.

The main casing 2 includes a front cover 2A, an opening 2B, a motor 21, and a sheet discharge tray 22, and conveyance rollers 23. The front cover 2A is configured to open and close the opening 2B. The motor 21 inputs driving force to a coupling 92 described below (refer to FIG. 2).

The feeder section 3 includes a sheet feeding tray 31, a sheet pressing plate 32, and a conveyance roller 33. The sheet pressing plate 32 presses a sheet S upward toward the conveyance roller 33. The conveyance roller 33 conveys the sheet S to the image forming section 4.

The image forming section 4 includes an exposing device 5, a process cartridge 10, and a fixing device 8.

The exposing device 5 includes a light emitting part, a polygon mirror, a lens, and a reflecting mirror, and so on (not shown). The exposing device 5 emits a laser beam onto the surface of a photosensitive drum 60 described below.

The process cartridge 10 is mounted to the main casing 2 through the opening 2B. The process cartridge 10 includes a drum cartridge 6 and a developing cartridge 7.

The drum cartridge 6 is configured such that the developing cartridge 7 is mounted thereto. The drum cartridge 6 includes the photosensitive drum 60, a charger 12, and a transfer roller 13. The photosensitive drum 60 rotates about a first axis X1 extending in a particular direction. The charger 12 faces the photosensitive drum 60. The transfer roller 13 faces the photosensitive drum 60.

The developing cartridge 7 includes a developing roller 18, a supply roller 19, a layer-thickness regulating blade 14, a toner accommodating section 15, an agitator 16, and a casing 17. The developing roller 18 is rotatable about a second axis X2 extending in the particular direction, in accordance with driving force inputted through the coupling 92. The surface of the developing roller 18 contacts the surface of the photosensitive drum 60 through toner. In the embodiment, toner is crushed toner. Generally, frictional force between the surface of the developing roller 18 and the surface of the photosensitive drum 60 is larger when crushed toner is used, than when polymerized toner is used. The casing 17 is formed of resin. The casing 17 is configured to accommodate toner.

The charger 12 charges the surface of the photosensitive drum 60. The charger 12 is spaced away from the surface of the photosensitive drum 60. The charger 12 is a scorotron charger, for example. The charger 12 includes a charging wire 12A and a grid electrode 12B. A charging bias is applied to between the charging wire 12A and the grid electrode 12B.

The transfer roller 13 is rotatable about a third axis extending in the particular direction. The surface of the transfer roller 13 contacts the surface of the photosensitive drum 60.

The exposing device 5 forms an electrostatic latent image on the photosensitive drum 60. The developing roller 18 supplies toner to the electrostatic latent image on the photosensitive drum 60. With this operation, toner becomes a toner image on the surface of the photosensitive drum 60. The transfer roller 13 is configured to transfer the toner image on the photosensitive drum 60 to the sheet S.

The fixing device 8 includes a heating roller 8A and a pressure roller 8B. The pressure roller 8B is configured to press the sheet S against the heating roller 8A. The heating roller 8A is configured to thermally fix a toner image onto the sheet S. The conveyance rollers 23 are configured to discharge the sheet S onto the sheet discharge tray 22.

Figure 2:
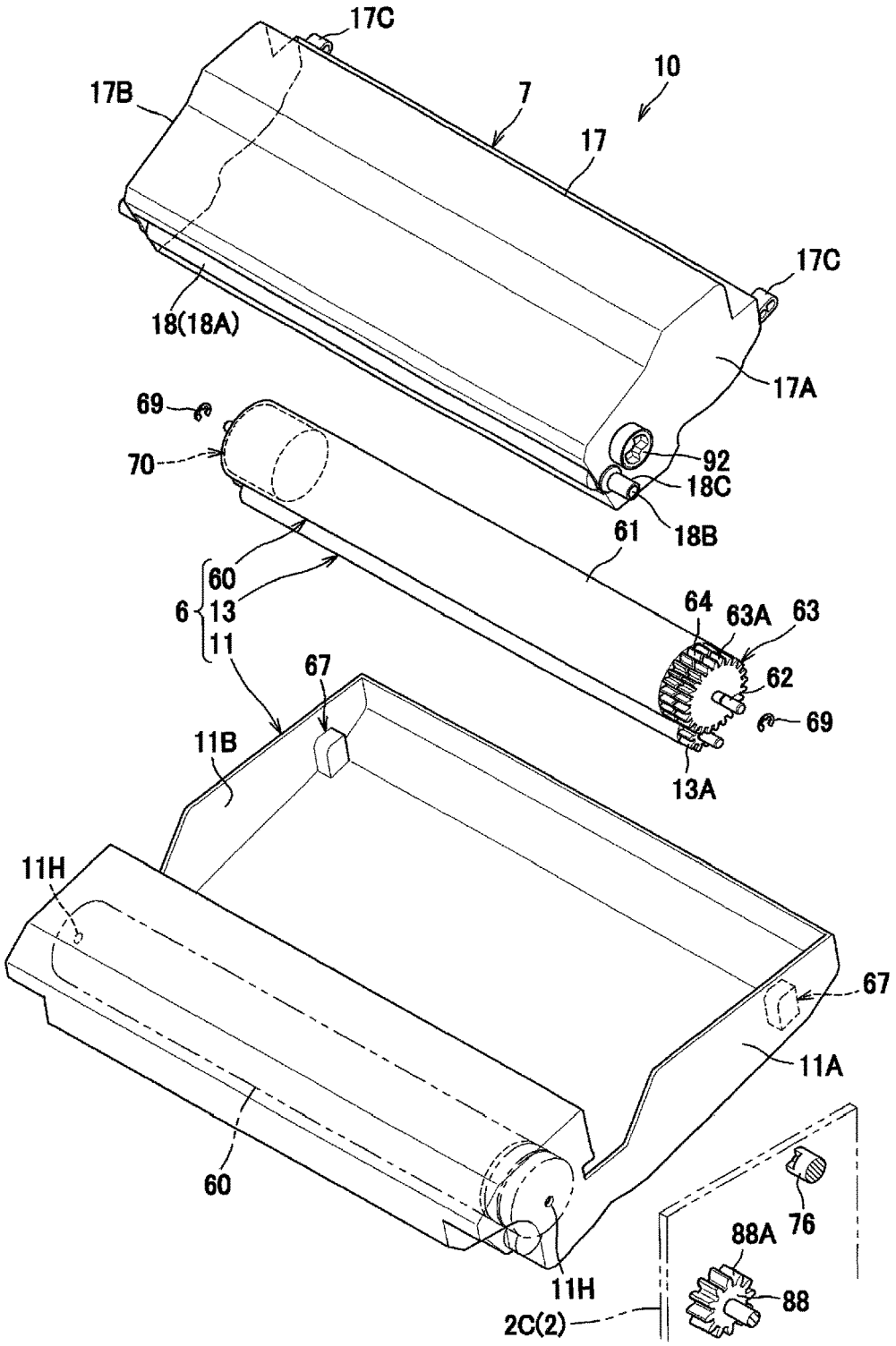
FIG. 2 is a perspective view showing a drum cartridge in a state where a photosensitive drum and a transfer roller are removed, a developing cartridge, and a part of an apparatus main body.

As shown in FIG. 2, the drum cartridge 6 includes a frame 11, the photosensitive drum 60, a resistance generating member 70, and the transfer roller 13.

The frame 11 includes a first frame 11A and a second frame 11B. The second frame 11B is located away from the first frame 11A in the particular direction. As indicated by the two-dot chain lines, the photosensitive drum 60 is located between the first frame 11A and the second frame 11B in a state where the photosensitive drum 60 is assembled to the frame 11.

The photosensitive drum 60 has a drum main body 61, a shaft 62, a first gear 63, and a transfer-roller drive gear 64.

The drum main body 61 is made of a metal tube. A photosensitive layer (not shown) is provided at the outer circumferential surface of the metal tube.

The shaft 62 supports the drum main body 61 through the first gear 63, the transfer-roller drive gear 64, and the resistance generating member 70. That is, a portion of the resistance generating member 70 constitutes a portion of the photosensitive drum 60. The shaft 62 penetrates the drum main body 61 in the particular direction. The first gear 63 and the transfer-roller drive gear 64 are fixed to the drum main body 61, and are rotatable together with the drum main body 61.

The first gear 63 includes a plurality of gear teeth 63A. The tooth surface of the plurality of gear teeth 63A is formed of an involute curve. The tooth thickness of the plurality of gear teeth 63A is deviated to a smaller side relative to an ideal involute curve. Further, the deviation amount of the tooth surface from the ideal involute curve increases from a tooth root toward a tooth tip. In other words, as it is closer to the tooth tip, the tooth thickness becomes narrower compared to the gear tooth of the ideal involute gear.

A second gear 88 is provided at a side frame 2C of the main casing 2. The second gear 88 includes a plurality of gear teeth 88A. The second gear 88 is made of an involute gear having the same module as the first gear 63. When the process cartridge 10 is mounted to the main casing 2, at least one gear tooth 63A of the plurality of gear teeth 63A of the first gear 63 engages at least one gear tooth 88A of the plurality of gear teeth 88A of the second gear 88.

Each of the first frame 11A and the second frame 11B has a penetration hole 11H. By inserting the shaft 62 in the two penetration holes 11H and the drum main body 61 in a state where the photosensitive drum 60 is arranged at a particular position, the photosensitive drum 60 is supported at the frame 11 such that the photosensitive drum 60 is rotatable. The shaft 62 is attached to the frame 11 with clip rings 69 such that the shaft 62 does not come off the frame 11.

The transfer roller 13 is rotatable about a third axis X3 (see FIG. 1) extending in the particular direction. The transfer roller 13 is rotatably supported at the frame 11 through a bearing member (not shown). The transfer roller 13 has a transfer roller gear 13A at an end portion of the main body of the transfer roller 13. The transfer roller gear 13A engages the transfer-roller drive gear 64. With this configuration, when the photosensitive drum 60 rotates, rotational force is transmitted from the transfer-roller drive gear 64 to the transfer roller gear 13A, and the transfer roller 13 rotates.

In the embodiment, except the sheet S and toner T that are print medium, only the surface of the developing roller 18 and the surface of the transfer roller 13 contact the surface of the photosensitive drum 60. The process cartridge 10 is a cleanerless type of using the developing roller 18 to remove residual toner and foreign matter on the surface of the photosensitive drum 60, without having a cleaner that contacts the surface of the photosensitive drum 60.

The casing 17 of the developing cartridge 7 includes a side frame 17A, a side frame 17B, and protruding portions 17C. The side frame 17B is located away from the side frame 17A in the particular direction. Each protruding portion 17C protrudes in a direction away from the developing roller 18. The protruding portions 17C are provided at both ends of the casing 17 and spaced away from each other in the particular direction. The developing roller 18 is located between the side frame 17A and the side frame 17B in a state where the developing roller 18 is assembled to the casing 17. The developing roller 18 has a roller main body 18A and a shaft 18B.

Both ends of the shaft 18B are supported by bearing members 18C, and each bearing member 18C is supported by the side frames 17A, 17B. The roller main body 18A is made of conductive rubber, and is fixed to the shaft 18B.

The developing cartridge 7 includes the coupling 92 configured to rotate. The coupling 92 is provided at the side frame 17A. The coupling 92 has a coupling gear 92A (see FIG. 5) at the inner side of the side frame 17A. A driving-force input member 86 (see FIG. 5) is provided at the side frame 2C of the main casing 2. The driving-force input member 86 engages the coupling 92 and inputs driving force to the developing roller 18. When the developing cartridge 7 is mounted to the main casing 2, the coupling 92 engages the driving-force input member 86. The coupling 92 is configured to receive driving force for rotating the developing roller 18 from the driving-force input member 86.

The developing roller 18 includes a developing roller gear 18D (see FIG. 5) at one end portion of the main body of the developing roller 18. The developing roller gear 18D engages the coupling gear 92A.

Figure 3A:
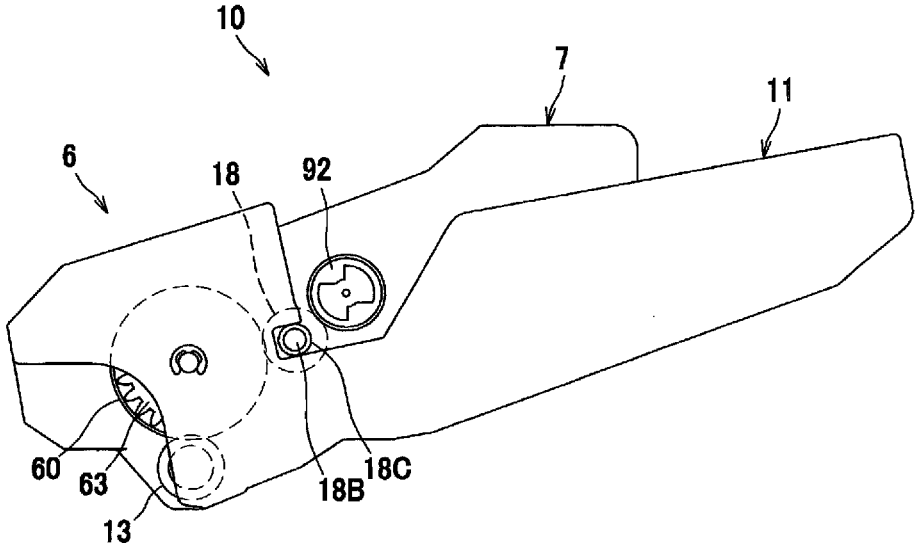
FIG. 3A is a side view of a process cartridge.
Figure 3B:
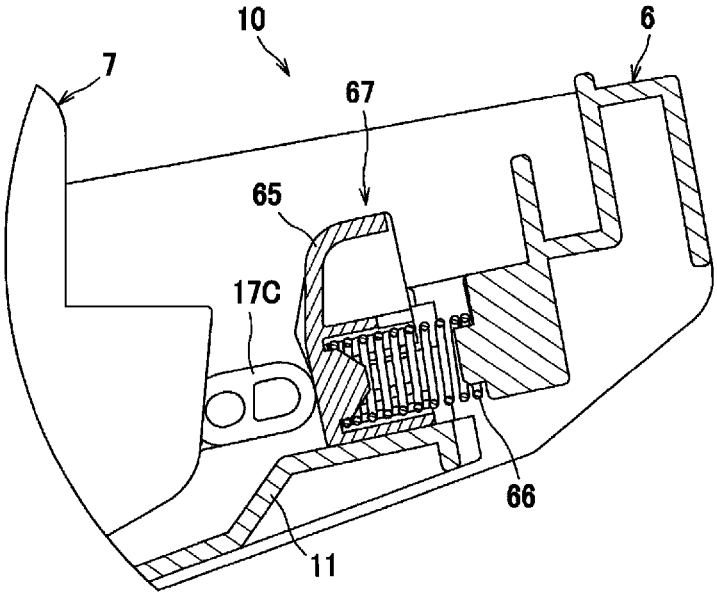
FIG. 3B is a partial enlarged cross-sectional view of the process cartridge.

As shown in FIG. 3B, the drum cartridge 6 includes pressing mechanisms 67. The pressing mechanisms 67 is configured to lock the developing cartridge 7 to the drum cartridge 6, and press the developing roller 18 toward the photosensitive drum 60. Specifically, the pressing mechanism 67 includes a pressing member 65 and a spring 66. The spring 66 is a compressed coil spring. One end of the spring 66 contacts the frame 11. The other end of the spring 66 contacts the pressing member 65. As shown in FIG. 2, the pressing mechanisms 67 are provided to correspond to the protruding portions 17C at both ends of the casing 17. Specifically, the pressing mechanisms 67 are provided at both ends of the frame 11 so as to be away from each other in the particular direction.

As shown in FIG. 3A, when the developing cartridge 7 is mounted to the drum cartridge 6, as shown in FIG. 3B, each pressing member 65 presses each protruding portion 17C of the developing cartridge 7 by urging force of the spring 66. With this configuration, the surface of the developing roller 18 is pressed against the surface of the photosensitive drum 60.

Figure 4:
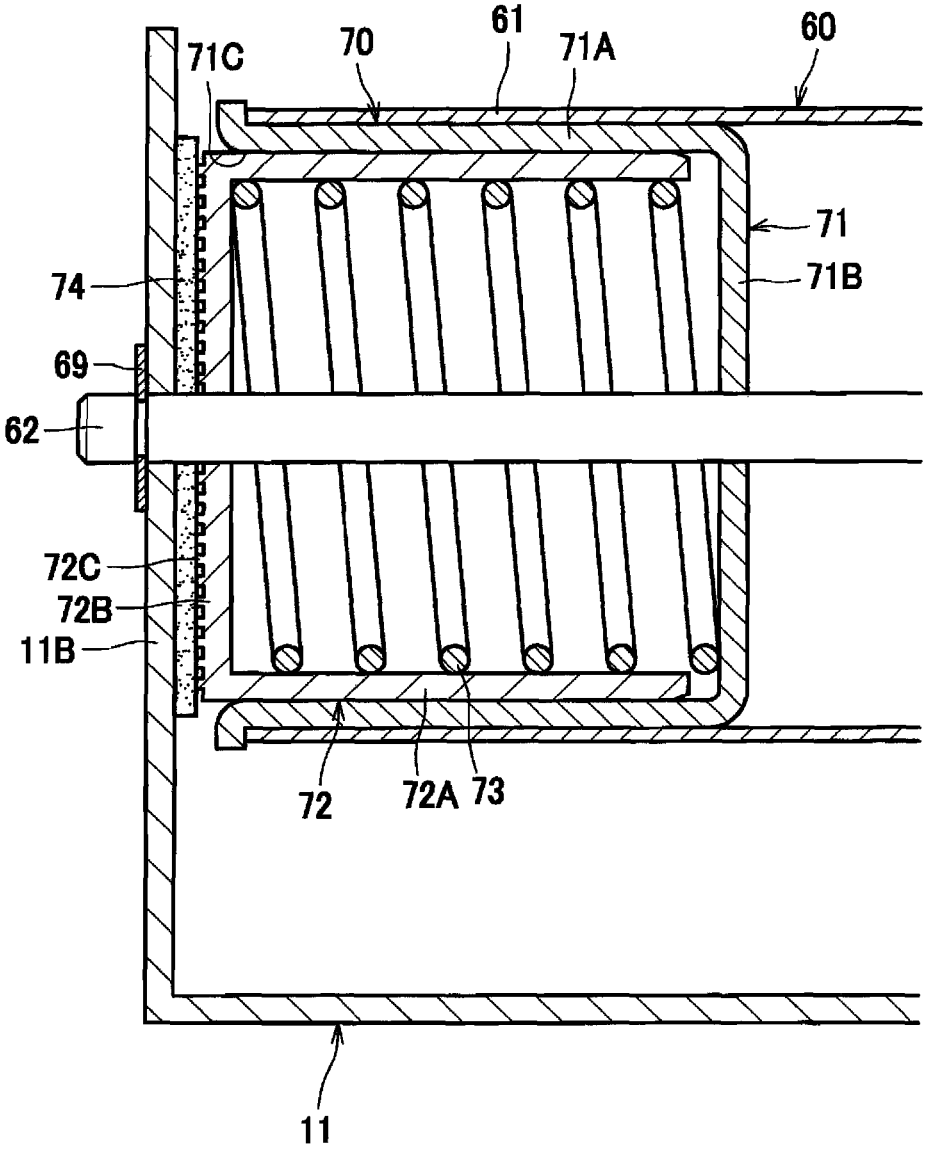
FIG. 4 is a cross-sectional view illustrating the configuration of a resistance generating member.

As shown in FIG. 4, the resistance generating member 70 includes a spring receiving member 71, a piston 72, a spring 73 as an example of an urging member, and a pad 74. Among the members constituting the resistance generating member 70, the spring receiving member 71, the piston 72, and spring 73 constitute the photosensitive drum 60.

The spring receiving member 71 is a member of a cylindrical shape having a bottom. The spring receiving member 71 has a cylindrical portion 71A and a bottom portion 71B. The outer circumference of the cylindrical portion 71A of the spring receiving member 71 fits inside the drum main body 61. An opening 71C of the cylindrical portion 71A faces toward one end side of the drum main body 61.

The piston 72 is a member of a cylindrical shape having a bottom. The piston 72 has a cylindrical portion 72A and a bottom portion 72B. The outer circumference of the cylindrical portion 72A of the piston 72 fits inside the cylindrical portion 71A of the spring receiving member 71. The bottom portion 72B of the piston 72 is located at one end side of the drum main body 61. The piston 72 is slidably movable relative to the spring receiving member 71 in the axial direction of the cylindrical portion 71A.

The spring 73 is a compressed coil spring. The spring 73 in a compressed state is located between the bottom portion 71B of the spring receiving member 71 and the bottom portion 72B of the piston 72. The spring 73 is configured to constantly urge the piston 72 in a direction away from the bottom portion 71B of the spring receiving member 71. By adjusting strength (elasticity) of the spring 73, the resistance at the time of rotation of the photosensitive drum 60 relative to the frame 11 can be adjusted.

The pad 74 is affixed to the surface of the second frame 11B at the drum main body 61 side. That is, the pad 74 is located between the second frame 11B and the bottom portion 72B of the piston 72 that is an end portion of the photosensitive drum 60. The pad 74 is a member for generating a moderate friction coefficient so that the photosensitive drum 60 rotates relative to the frame 11 with moderate frictional force. The pad 74 is made of felt, for example. The pad 74 faces the bottom portion 72B of the piston 72. That is, the pad 74 contacts the end portion of the photosensitive drum 60 and contacts the second frame 11B.

A plurality of ridges 72C is formed on the surface of the bottom portion 72B of the piston 72 facing the pad 74. The plurality of ridges 72C extends in a concentric circular shape having a center at the position of the shaft 62. The plurality of ridges 72C is provided such that the bottom portion 72B has a moderate friction coefficient relative to the pad 74.

The bottom portion 72B of the piston 72 is urged toward the second frame 11B by urging force of the spring 73 and is pressed against the pad 74, which causes the resistance generating member 70 to generate a resistance torque TQ1 that serves as resistance when the photosensitive drum 60 rotates relative to the frame 11. Further, the photosensitive drum 60 is urged toward the first frame 11A due to reaction force of the force that the piston 72 is urged toward the second frame 11B. That is, the spring 73 urges the photosensitive drum 60 toward the first frame 11A. This suppresses wobble of the photosensitive drum 60 in the first axis X1 direction.

Figure 5:
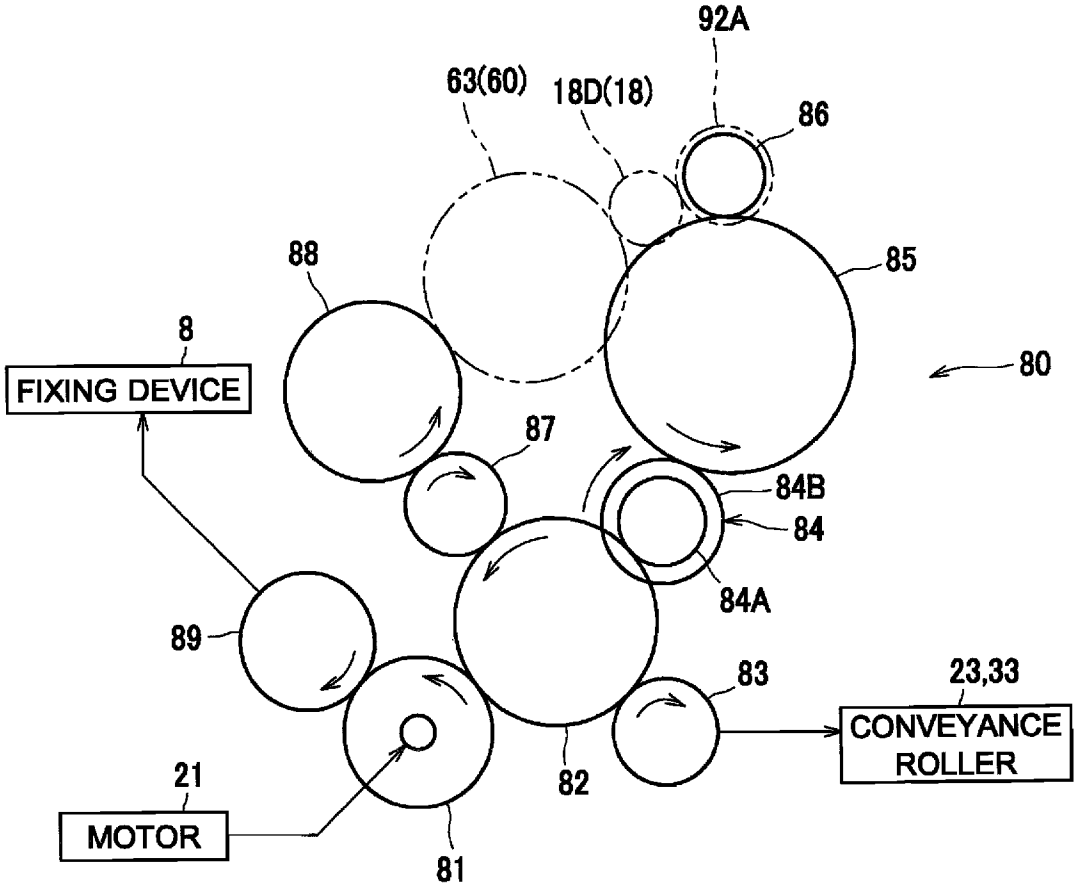
FIG. 5 is a diagram illustrating a gear train.

As shown in FIG. 5, the motor 21 is coupled to the second gear 88 and the driving-force input member 86 through a gear train 80. The motor 21 is also coupled to a sheet conveying system such as the conveyance rollers 23, 33 and coupled to the fixing device 8, which are other than the second gear 88 and the driving-force input member 86, through the gear train 80. That is, the laser printer 1 includes the conveyance rollers 23, 33 and the fixing device 8 as an example of the driven member different from the developing roller 18 and the photosensitive drum 60. And, the gear train 80 couples the motor 21 to the driven members such that the motor 21 drives these driven members.

As an example, the gear train 80 includes a drive gear 81, a first idle gear 82, a second idle gear 83, a speed change gear 84, a third idle gear 85, a fourth idle gear 87, and a fifth idle gear 89.

The drive gear 81 is directly connected to an output shaft of the motor 21. The first idle gear 82 engages the drive gear 81. The second idle gear 83 engages the first idle gear 82 to receive driving force from the first idle gear 82. The second idle gear 83 is coupled to the conveyance rollers 23, 33 through a plurality of idle gears.

The speed change gear 84 includes a small-diameter gear 84A and a large-diameter gear 84B that rotate together. The diameter of the small-diameter gear 84A is smaller than the diameter of the large-diameter gear 84B. The small-diameter gear 84A engages the first idle gear 82. The large-diameter gear 84B engages the third idle gear 85.

The third idle gear 85 engages a gear of the driving-force input member 86. The driving-force input member 86 is configured to receive driving force from the motor 21 through the drive gear 81, the first idle gear 82, the speed change gear 84, and the third idle gear 85.

The fourth idle gear 87 engages the first idle gear 82. The fourth idle gear 87 engages the second gear 88. With this configuration, the second gear 88 rotates at a rotational speed in accordance with the rotational speed of the motor 21.

The speed change gear 84 is provided in a line from the drive gear 81 to the developing roller gear 18D, while no speed change gear is provided in a line from the drive gear 81 to the first gear 63. Due to this, the circumferential speed of the developing roller 18 is higher than the circumferential speed of the photosensitive drum 60. Preferably, the circumferential speed of the developing roller 18 is 1.3 to 1.7 times the circumferential speed of the photosensitive drum 60. More preferably, the circumferential speed of the developing roller 18 is 1.55 times the circumferential speed of the photosensitive drum 60. As an example, the circumferential speed of the developing roller 18 is approximately 1.5 times the circumferential speed of the photosensitive drum 60. That is, in the process cartridge 10 of the embodiment, the circumferential speed of the developing roller 18 is higher than the circumferential speed of the photosensitive drum 60.

The fifth idle gear 89 engages the drive gear 81. The fifth idle gear 89 is coupled to the fixing device 8 through a plurality of idle gears. For example, the fifth idle gear 89 is coupled to the gear of the heating roller 8A or the pressure roller 8B of the fixing device 8 through the plurality of idle gears.

Figure 6A:
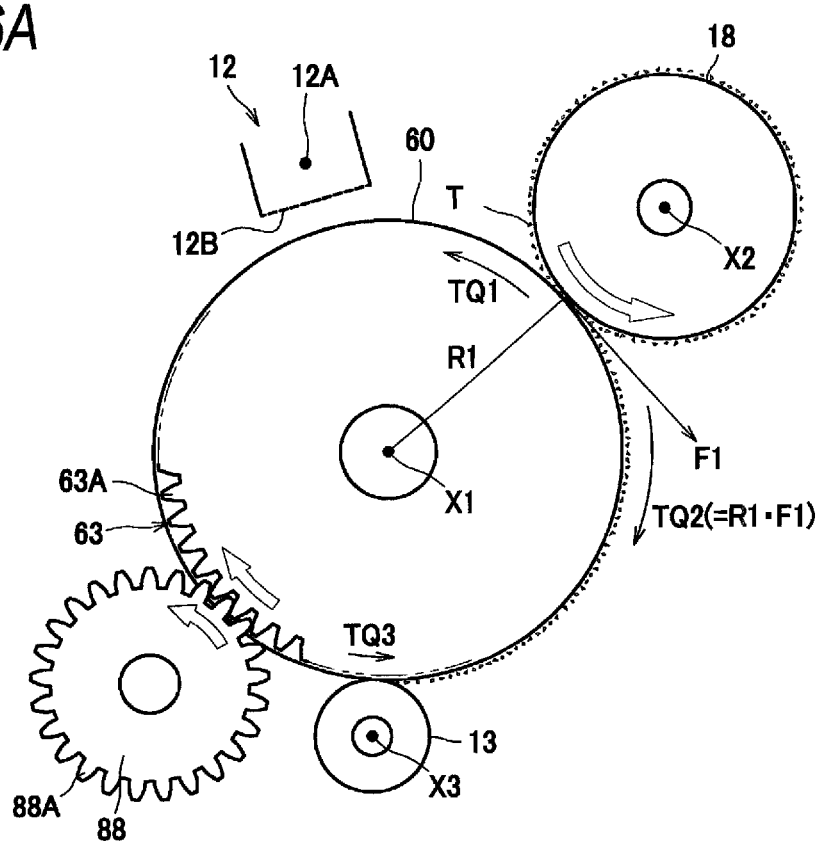
FIG. 6A is a diagram around the photosensitive drum for illustrating an operation of rotating the photosensitive drum.

As shown in FIG. 6A, the surface of the developing roller 18 contacts the surface of the photosensitive drum 60 through toner T. When the developing roller 18 rotates, frictional force F1 (dynamic frictional force) is generated due to contact of the surface of the developing roller 18 and the surface of the photosensitive drum 60 through toner T. A product R1·F1 of the frictional force F1 and a radius R1 of the photosensitive drum 60 is torque TQ2 that causes the photosensitive drum 60 to rotate due to friction between the surface of the developing roller 18 and the surface of the photosensitive drum 60.

The above-described resistance torque TQ1 generated by the resistance generating member 70 is smaller than the torque TQ2 (=R1·F1). That is, a relation TQ1<TQ2 is satisfied in the process cartridge 10, even when the developing roller 18 rotates in accordance with driving force in a state where the surface of the developing roller 18 contacts the surface of the photosensitive drum 60 through toner T. This relation reduces driving force required for rotating the photosensitive drum 60.

The transfer roller 13 is rotated by the photosensitive drum 60 due to engagement of the transfer-roller drive gear 64 and the transfer roller gear 13A. Thus, for the photosensitive drum 60, torque TQ3 for rotating the transfer roller 13 serves as resistance. The magnitude of the sum of the resistance torque TQ1 and the torque TQ3 serving as resistance when the photosensitive drum 60 rotates is smaller than the magnitude of the torque TQ2. That is, a relation TQ1+TQ3<TQ2 is satisfied. This configuration enables the photosensitive drum 60 to rotate by following rotation of the developing roller 18. That is, the photosensitive drum 60 is rotated by rotation of the developing roller 18.

Preferably, a torque difference TQ1−TQ2 is smaller than or equal to −2 [Ncm]. More preferably, the torque difference TQ1−TQ2 is −3 to −7 [Ncm]. With this configuration, when the photosensitive drum 60 rotates following the developing roller 18, rotation unevenness of the photosensitive drum 60 can be reduced.

The operations and effects of the above-described process cartridge 10 and laser printer 1 will be described.

When the motor 21 drives to rotate the developing roller 18 through the coupling 92, the developing roller 18 rotates at a circumferential speed that is approximately 1.5 times the circumferential speed of the photosensitive drum 60. At this time, due to the frictional force F1 between the surface of the developing roller 18 and the surface of the photosensitive drum 60, the surface of the photosensitive drum 60 is pulled in the moving direction of the surface of the developing roller 18. In FIG. 6A, the developing roller 18 rotates in a counter-clockwise direction, and hence the surface of the photosensitive drum 60 is pulled in a clockwise direction by the surface of the developing roller 18.

From the viewpoint of the developing roller 18, the frictional force between the surface of the developing roller 18 and the surface of the photosensitive drum 60 serves as resistance or brake against rotation of the developing roller 18.

As described above, the process cartridge 10 satisfies the relation TQ1+TQ3<TQ2, and the torque TQ2 due to friction is larger than all the resistance that acts when the photosensitive drum 60 rotates. This enables the photosensitive drum 60 to rotate following the developing roller 18 having a higher circumferential speed.

Here, because the first gear 63 engages the second gear 88, the speed of the first gear 63 is limited by the second gear 88. That is, the second gear 88 rotates at a rotational speed in accordance with the rotational speed of the motor 21. Here, the second gear 88 does not serve to drive the first gear 63, but serves to limit the speed of the first gear 63 so that the first gear 63 does not rotate too fast. So to speak, the second gear 88 serves as a speed limiting gear of the first gear 63.

Figure 6B:
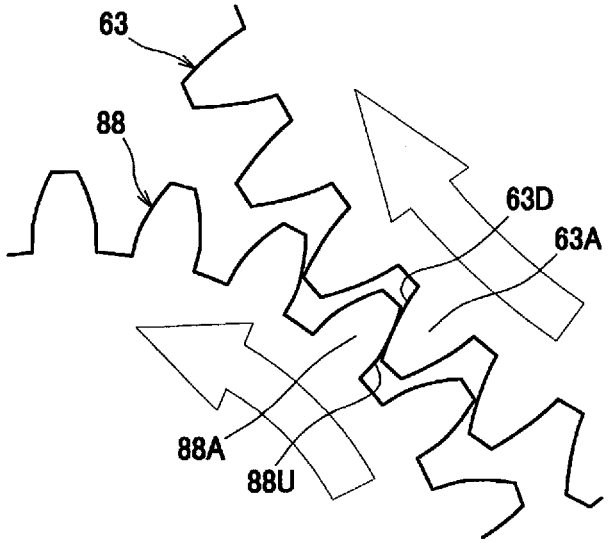
FIG. 6B is an enlarged view for illustrating gear engagement.

Thus, as shown in the enlarged view of FIG. 6B, in a state where the developing roller 18 rotates in accordance with the driving force, a tooth surface 63D, at a downstream side in the rotational direction, of at least one tooth of the plurality of gear teeth 63A of the first gear 63 contacts a tooth surface 88U, at an upstream side in the rotational direction, of at least one tooth of the plurality of gear teeth 88A of the second gear 88.

In a comparative example, the elastic force of the spring 73 is strong, and a relation TQ1>TQ2 is satisfied. In this case, the photosensitive drum does not rotate following the developing roller. And, driving force of a gear of an apparatus main body mainly rotates the photosensitive drum, and frictional force between the surface of the developing roller and the surface of the photosensitive drum serves to assist rotation of the photosensitive drum.

Further, in a comparative example, because the resistance torque TQ1 is large, driving force large enough to overcome this resistance torque needs to be inputted from the second gear 88 and the developing roller 18 to the photosensitive drum 60.

In the process cartridge 10 of the embodiment, because the resistance torque TQ1 is smaller than the torque TQ2, driving force required for rotating the photosensitive drum 60 can be reduced. This reduces driving force required for rotating the developing roller 18 and the photosensitive drum 60.

Because the photosensitive drum 60 rotates following the rotation of the developing roller 18, no driving force for actively rotating the photosensitive drum 60 needs to be inputted from the second gear 88 to the photosensitive drum 60.

In a case where driving force for rotating the photosensitive drum 60 is received by a gear, there is a possibility that the photosensitive drum 60 rotates unevenly due to a manufacturing error of the gear and so on, which may lead to banding. In the embodiment, however, the developing roller 18 receives driving force through the coupling 92, and the photosensitive drum 60 rotates by following the developing roller 18. This suppresses rotation unevenness of the photosensitive drum 60 and reduces banding.

Figure 7:
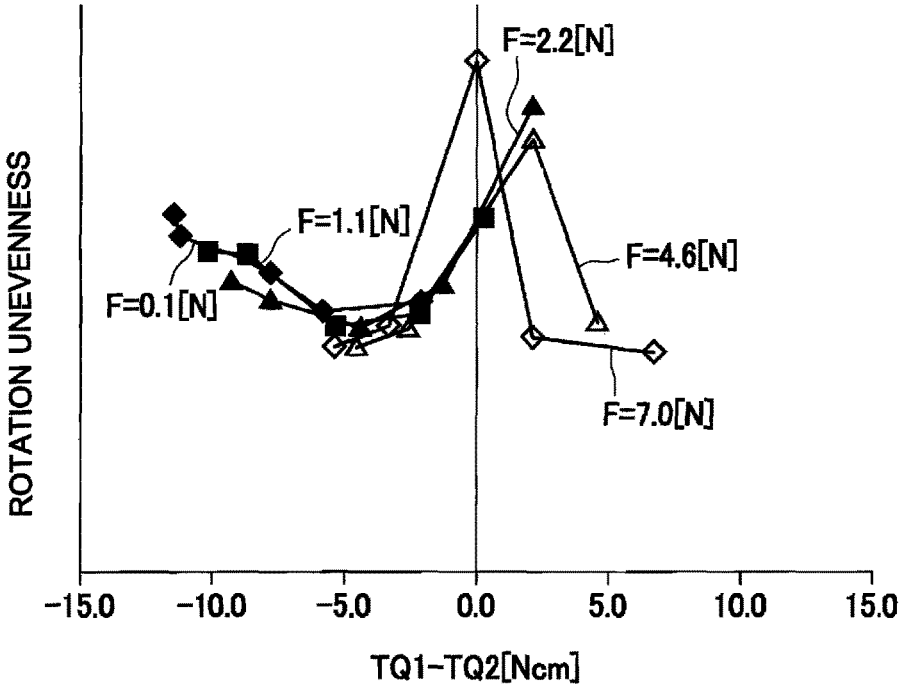
FIG. 7 is a graph showing a relation between TQ1-TQ2 and rotation unevenness.

In particular, the torque difference TQ1−TQ2 is smaller than or equal to −2 [Ncm] and, more preferably, the torque difference TQ1−TQ2 is −3 to −7 [Ncm], which effectively suppresses rotation unevenness of the photosensitive drum 60. FIG. 7 shows a result of experimentation in which the applicant confirmed this. In this experimentation, the first gear 63 and the second gear 88 having the following specifications were used.

<First Gear (Involute Helical Gear)>
Module: 0.8
Number of teeth: 33
Pressure angle: 20 degrees
Helical angle: 18 degrees
<Second Gear (Involute Helical Gear)>
Module: 0.8
Number of teeth: 30
Pressure angle: 20 degrees
Helical angle: 18 degrees In FIG. 7, "F" is the urging force of the spring 73. As the spring 73, springs of five kinds having the urging force F of 0.1[N] to 7.0[N] were prepared, and rotation unevenness of the photosensitive drum 60 was measured for each of torque differences TQ1−TQ2.

As a result, although rotation unevenness was generated in a region in which TQ1−TQ2 is in a vicinity of zero, rotation unevenness was stable in relatively small values in a region in which TQ1−TQ2 is smaller than or equal to −2 [Ncm]. In particular, the rotation unevenness of the photosensitive drum 60 was small in the region in which TQ1−TQ2 is −3 to −7 [Ncm].

Further, by setting tooth thickness of the plurality of gear teeth 63A of the first gear 63 to be a relatively small thickness, the rotation unevenness of the photosensitive drum 60 can be suppressed.

Figure 8:
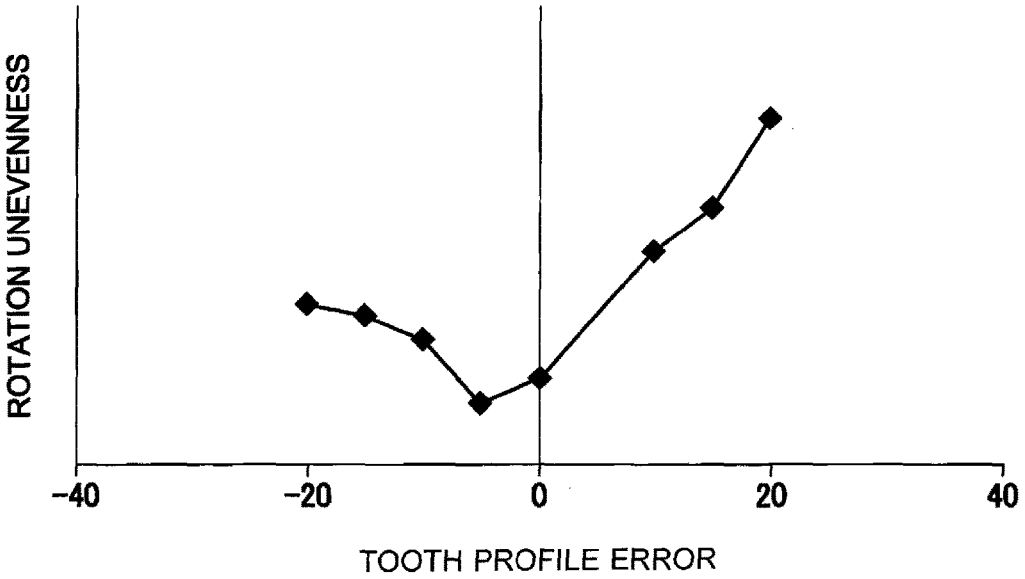
FIG. 8 is a graph showing a relation between tooth profile errors and rotation unevenness.

FIG. 8 shows a result of experimentation in which the applicant confirmed this. In this experimentation, the same gears as described above were used as the first gear 63 and the second gear 88, and rotation unevenness was measured for each of manufacturing errors of the tooth profile of the first gear 63. Here, the second gear 88 having an equivalent tooth profile error to the first gear 63 was used to be combined with the first gear 63. In FIG. 8, a positive (plus) tooth profile error indicates that the tooth profile has an error to a side at which tooth thickness increases relative to the ideal involute curve, and a negative (minus) tooth profile error indicates that the tooth profile has an error to a side at which tooth thickness decreases relative to the ideal involute curve.

As shown in FIG. 8, the rotation unevenness is smaller in the region in which tooth profile errors are negative, than in the region in which tooth profile errors are positive. In addition, changes of the rotation unevenness in response to changes of the tooth profile error are smaller in the region in which tooth profile errors are negative, than in the region in which tooth profile errors are positive.

Further, in the plurality of gear teeth 63A, the deviation amount of the tooth surface from the ideal involute curve increases from a tooth root toward a tooth tip. This further suppresses the rotation unevenness of the photosensitive drum 60.

The process cartridge 10 of the embodiment uses crushed toner as toner T. Hence, the friction coefficient between the surface of the photosensitive drum 60 and the surface of the developing roller 18 can be easily increased to achieve the relation TQ1<TQ2. Further, by reversing the way of thinking to adopt the relation TQ1<TQ2 when crushed toner is used, driving force required for driving the photosensitive drum 60 and the developing roller 18 can be reduced especially.

The laser printer 1 of the embodiment is configured such that the motor 21 not only drives the developing roller 18 but also drives other driven members such as the conveyance rollers 23 and 33. Thus, torque (inertia) for driving the driven members serves as resistance against speed fluctuations of the second gear 88. This further suppresses the rotation unevenness of the photosensitive drum 60.

While the disclosure is described in detail with reference to the above aspects thereof, it would be apparent to those skilled in the art that various changes and modifications may be made therein without departing from the scope of the claims.

For example, in the above-described embodiment, the members configured to contact the photosensitive drum are only the developing roller and the transfer roller. However, another member may contact the photosensitive drum as long as such member does not serve as much resistance against rotation of the photosensitive drum. For example, a charging roller or a cleaning roller may contact the photosensitive drum.

In the above-described embodiment, the process cartridge is a type that is separated into the developing cartridge and the drum cartridge. The process cartridge may be a type that cannot be separated into the developing cartridge and the drum cartridge, that is, a type having a developing cartridge and a drum cartridge as an integral cartridge. Further, this disclosure may be applied to a process cartridge of a type that a toner cartridge storing toner is separated from a developing cartridge having a developing roller.

In the above-described embodiment, although this disclosure is applied to the laser printer 1, this disclosure is not limited to this. This disclosure may be applied to other image forming apparatuses, such as a copier and a multifunction peripheral.

Further, each element described in the above-described embodiment and modifications may be combined and implemented arbitrarily.

What is claimed is:

1. A process cartridge comprising:

a photosensitive drum rotatable about a first axis extending in a particular direction;

a frame rotatably supporting the photosensitive drum;

a developing roller rotatable according to driving force about a second axis extending in the particular direction, a surface of the developing roller contacting a surface of the photosensitive drum through toner; and a resistance generating member configured to generate a resistance torque TQ1 serving as resistance between the frame and photosensitive drum in a case where the photosensitive drum rotates relative to the frame, wherein, in a case where the developing roller rotates according to the driving force in a state where the surface of the developing roller contacts the surface of the photosensitive drum through toner, the resistance torque TQ1 is smaller than a torque TQ2 that causes the photosensitive drum to rotate due to friction between the surface of the developing roller and the surface of the photosensitive drum, the torque TQ2 being applied to the photosensitive drum by the developing roller.

2. The process cartridge according to claim 1, wherein the frame comprises:

a first frame; and a second frame located away from the first frame in the particular direction;

wherein the photosensitive drum is located between the first frame and the second frame; and wherein the resistance generating member comprises an urging member configured to urge the photosensitive drum toward the first frame.

3. The process cartridge according to claim 2, wherein the urging member comprises a spring.

4. The process cartridge according to claim 2, wherein the resistance generating member comprises a felt located between an end portion of the photosensitive drum and the second frame, the felt contacting the end portion of the photosensitive drum and the second frame.

5. The process cartridge according to claim 1, wherein the photosensitive drum includes a first gear; and wherein the process cartridge further comprises a coupling configured to receive the driving force.

6. The process cartridge according to claim 5, wherein the first gear comprises a plurality of gear teeth; and wherein a tooth surface of each of the plurality of gear teeth is formed of an involute curve, and is deviated to a side at which tooth thickness is small relative to an ideal involute curve.

7. The process cartridge according to claim 6, wherein a deviation amount of the tooth surface from the ideal involute curve increases from a tooth root toward a tooth tip.

8. The process cartridge according to claim 1, further comprising a charger configured to charge the photosensitive drum, the charger being spaced away from the surface of the photosensitive drum.

9. The process cartridge according to claim 8, wherein the charger is a scorotron charger.

10. The process cartridge according to claim 1, wherein the process cartridge further comprises a transfer roller rotatable about a third axis extending in the particular direction, a surface of the transfer roller contacting the surface of the photosensitive drum; and wherein only the surface of the developing roller and the surface of the transfer roller contact the surface of the photosensitive drum.

11. The process cartridge according to claim 1, wherein the process cartridge further comprises a transfer roller rotatable about a third axis extending in the particular direction, a surface of the transfer roller contacting the surface of the photosensitive drum; and wherein the process cartridge is a cleanerless type.

12. The process cartridge according to claim 1, wherein the process cartridge comprises:

a developing cartridge including the developing roller; and a drum cartridge configured to receive the developing cartridge, the drum cartridge including the photosensitive drum and the resistance generating member.

13. The process cartridge according to claim 2, wherein the process cartridge comprises:

a developing cartridge including the developing roller; and a drum cartridge configured to receive the developing cartridge, the drum cartridge including the photosensitive drum, the first frame, the second frame, and the resistance generating member.

14. The process cartridge according to claim 5, wherein the process cartridge comprises:

a developing cartridge including the developing roller and the coupling; and a drum cartridge configured to receive the developing cartridge, the drum cartridge including the photosensitive drum, the first gear, and the resistance generating member.

15. The process cartridge according to claim 8, wherein the process cartridge comprises:

a developing cartridge including the developing roller; and a drum cartridge configured to receive the developing cartridge, the drum cartridge including the photosensitive drum and the charger.

16. The process cartridge according to claim 10, wherein the process cartridge comprises:

a developing cartridge including the developing roller; and a drum cartridge configured to receive the developing cartridge, the drum cartridge including the photosensitive drum and the transfer roller.

17. The process cartridge according to claim 1, wherein the toner is crushed toner.

18. The process cartridge according to claim, wherein a torque difference TQ1−TQ2 is smaller than or equal to −2 [Ncm].

19. The process cartridge according to claim 18, wherein the torque difference TQ1−TQ2 is −3 to −7 [Ncm].

20. An image forming apparatus comprising:

a process cartridge comprising:

a photosensitive drum rotatable about a first axis extending in a particular direction, the photosensitive drum including a first gear;

a frame rotatably supporting the photosensitive drum;

a developing roller rotatable according to driving force about a second axis extending in the particular direction, a surface of the developing roller contacting a surface of the photosensitive drum through toner;

a resistance generating member configured to generate a resistance torque serving as resistance between the frame and photosensitive drum in a case where the photosensitive drum rotates relative to the frame; and a coupling configured to receive the driving force, wherein, in a case where the developing roller rotates according to the driving force in a state where the surface of the developing roller contacts the surface of the photosensitive drum through toner, the resistance torque TQ1 is smaller than a torque TQ2 that causes the photosensitive drum to rotate due to friction between the surface of the developing roller and the surface of the photosensitive drum, the torque TQ2 being applied to the photosensitive drum by the developing roller; and an apparatus main body to which the process cartridge is mounted, the apparatus main body comprising:

a motor;

a second gear engaging the first gear, the second gear rotatable at a rotational speed in accordance with a rotational speed of the motor; and a driving-force input member configured to input the driving force to the developing roller.

21. The image forming apparatus according to claim 20, wherein a circumferential speed of the developing roller is higher than a circumferential speed of the photosensitive drum.

22. The image forming apparatus according to claim 20, wherein a circumferential speed of the developing roller is 1.3 to 1.7 times a circumferential speed of the photosensitive drum.

23. The image forming apparatus according o claim 20, further comprising:

a driven member different from the developing roller and the photosensitive drum; and a gear train coupling the motor to the driven member such that the motor drives the driven member.

24. The image forming apparatus according to claim 20, wherein, in a state where the developing roller rotates according to the driving force, a tooth surface, at a downstream side in a rotational direction of the first gear, of at least one gear tooth of a plurality of gear teeth of the first gear contacts a tooth surface, at an upstream side in a rotational direction of the second gear, of at least one gear tooth of a plurality of gear teeth of the second gear.

* * * * *